US006289970B1

(12) United States Patent
Fehlemann

(10) Patent No.: US 6,289,970 B1
(45) Date of Patent: Sep. 18, 2001

(54) MOLD WALL OF A CONTINUOUS CASTING MOLD

(75) Inventor: Gereon Fehlemann, Düsseldorf (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/388,708

(22) Filed: Sep. 2, 1999

(30) Foreign Application Priority Data

Sep. 17, 1998 (DE) ..... 198 42 674

(51) Int. Cl.[7] ..... B22D 11/124
(52) U.S. Cl. ..... 164/443; 164/485
(58) Field of Search ..... 164/485, 443, 164/348

(56) References Cited

U.S. PATENT DOCUMENTS 3,618,658 * 11/1971 Gallucci ..... 164/281
3,654,989 * 4/1972 Meier et al. ..... 165/47
3,978,910 * 9/1976 Gladwin ..... 164/283 M
4,009,749 * 3/1977 Alberny ..... 164/147
4,053,010 * 10/1977 Boccon-Gibod ..... 164/86
4,129,175 * 12/1978 Gladwin ..... 164/444
4,224,977 * 9/1980 Cygler et al. ..... 164/82
4,640,337 * 2/1987 Sevastakis ..... 164/443
4,714,103 * 12/1987 Polick et al. ..... 164/486
4,715,425 * 12/1987 Brosch ..... 164/418
5,117,895 * 6/1992 Hargassner et al. ..... 164/443
5,355,936 * 10/1994 Kumashiro et al. ..... 164/435
5,785,112 * 7/1998 Carrupt et al. ..... 164/472
6,173,756 * 1/2001 Fehlemann ..... 164/443

FOREIGN PATENT DOCUMENTS 2 087 769 * 6/1982 (GB) ..... B22D/11/04

* cited by examiner

*Primary Examiner*—Tom Dunn
*Assistant Examiner*—Kevin P. Kerns
(74) *Attorney, Agent, or Firm*—Friedrich Kueffner

(57) ABSTRACT

A mold wall of a continuous casting mold is composed of an inner mold plate and a water box connected to the inner mold plate through screw connections, wherein the inner mold plate has on its side facing the water box webs with grooves extending between the webs, and wherein the grooves have a groove width and filler pieces are arranged in the grooves. The grooves of the mold plate have undercuts with an undercut thickness, the filler pieces have connecting elements with a connecting element thickness, the filler pieces engage releasably in the undercuts, and the screw connections are arranged between the filler pieces and the water box.

10 Claims, 4 Drawing Sheets

MOLD WALL OF A CONTINUOUS CASTING MOLD

BACKGROUND OF THE INVENTION

1. Field of the Invention

The present invention relates to a mold wall of a continuous casting mold. The mold wall is composed of an inner mold plate and a water box connected to the inner mold plate through screw connections, wherein the slide of the inner mold plate facing the water box has webs with grooves extending between the webs, wherein the grooves have a groove width and filler pieces are arranged in the grooves.

2. Description of the Related Art

A mold wall of the above-described type is generally known in the art. The grooves serve as cooling ducts for a cooling liquid, which is usually water. The filler pieces serve to reduce the cross-section of the ducts, so that the flow velocity of the cooling liquid in the cooling duct is increased. However, the filler pieces do not have a supporting function. Fastening of the inner mold wall to the water box is effected through a plurality of screws which at least partially extend through the water box and are screwed into threaded pieces which are arranged in the inner mold plate.

The mold wall of the prior art described above has several disadvantages. In particular, mounting of the threaded pieces in the inner mold plate is very complicated. In addition, the inner mold plate usually is of copper, while the threaded pieces are of steel. Consequently, when a worn inner mold plate is exchanged, the copper has a large quantity of impurities and the inner mold plate is difficult to recycle.

SUMMARY OF THE INVENTION

Therefore, it is the primary object of the present invention to provide a mold wall of a continuous casting mold which avoids the disadvantages of the prior art.

In accordance with the present invention the grooves have undercuts with an undercut thickness, the filler pieces have connecting elements with a connecting element thickness, the filler pieces engage releasably in the undercuts, and the screw connections are arranged between the filler pieces and the water box.

As a result of the configuration of the mold wall according to the present invention, the inner mold plate, which is a component which wears out, only has to have the webs for forming the cooling ducts. Further processing of the inner mold plate, particularly the assembly of screw connections in the inner mold plate, is not required. When the inner mold plate is disassembled, the inner mold plate of copper is automatically separated from the steel parts when the connecting elements are released. Consequently, the inner mold plate can be more easily recycled.

If the connecting element thickness is smaller than the undercut thickness, the connecting elements can be particularly easily inserted into the undercuts.

If the connecting elements and/or the undercuts are constructed conically, the connecting elements can be inserted without play into the undercuts.

If the connecting elements are constructed so as to be moveable out of the filler pieces, the filler pieces can be connected particularly simply to the grooves.

The releasable fastening of the filler pieces in the grooves can be effected, for example, by the features according to which the connecting elements have swivel elements which can be swivelled about swivelling axes, the swivel elements have a maximum length and a maximum width in swivel planes extending perpendicularly of the swivel axes, the maximum length is greater than the groove width, and the maximum width is at most equal to the groove width.

In this embodiment, the swivel elements may have, for example, a rectangular, elliptical or oval cross-section in the swivel plane.

As an alternative to the use of swivel elements, it is also possible that the connecting elements include expanding plates which can be moved by means of screws into the undercuts.

The expansion of the expanding plates may be effected, for example, by means of conically shaped spreading discs which are arranged between the screws and the expanding plates. Alternatively, or as an addition, the screws can be constructed at least in a portion thereof so as to taper conically.

If the connecting elements include spring elements, it is ensured that a positive engagement is maintained between the filler pieces and the webs even when the mold wall is heated.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

DESCRIPTION OF THE PREFERRED EMBODIMENTS

Figure 1:
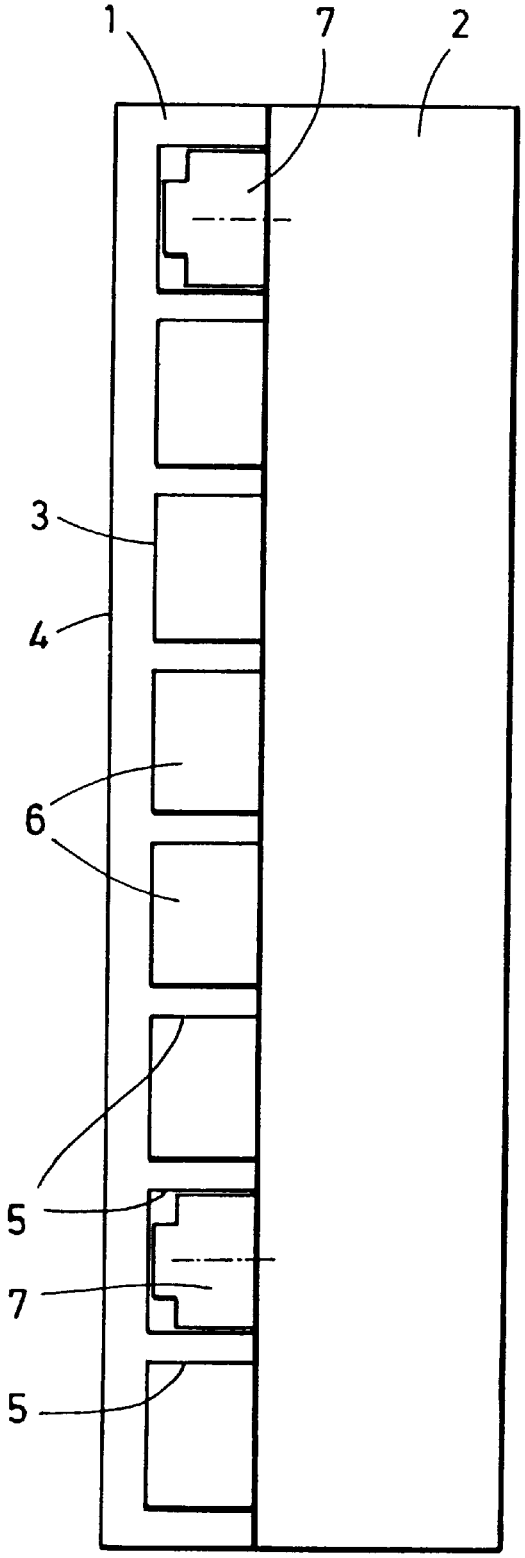
FIG. 1 is a sectional view of a mold wall of a continuous casting mold.

As illustrated in FIG. 1, a mold wall of a continuous casting mold is composed of an inner mold plate 1 and a water box 2. The inner mold plate 1 has an inner side 3 and an outer side 4. During operation of the continuous casting mold, the outer side 4 faces the liquid metal to be cast, particularly steel. The inner side 3, on the other hand, faces the water box 2. The inner mold plate 1 is connected to the water box 2 through screw connections. In FIG. 1, the screw connections are indicated by dash-dot lines.

Figure 2:
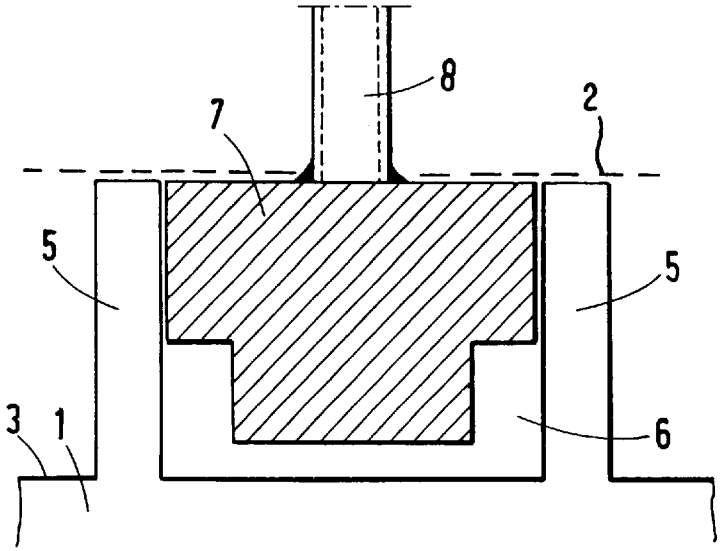
FIG. 2 is a sectional view of a screw connection.
Figure 6:
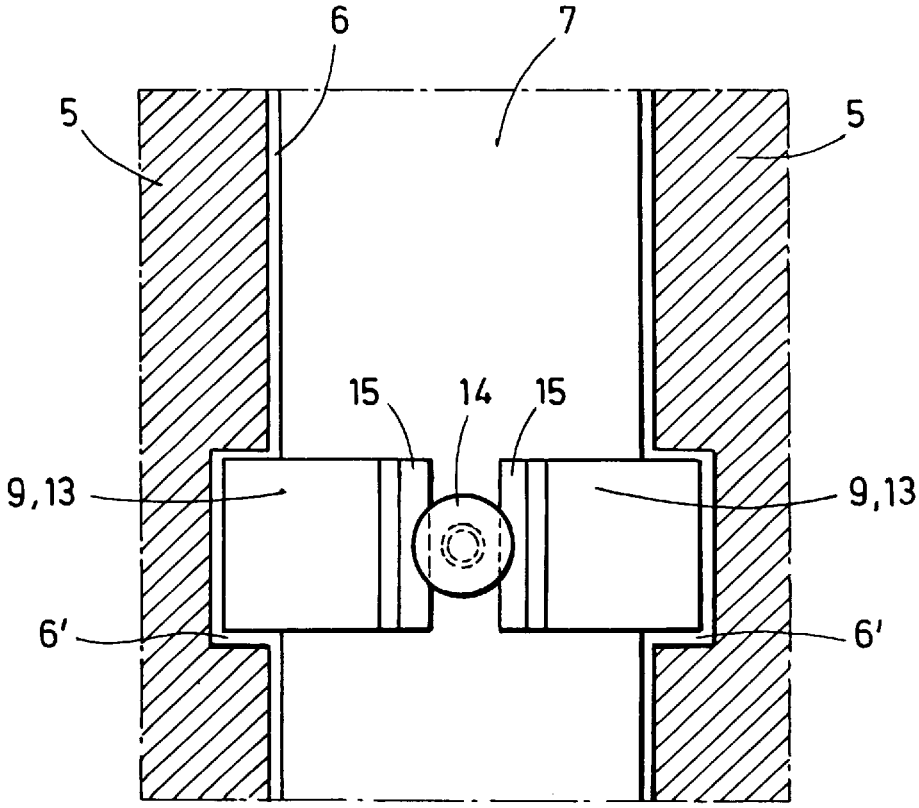
FIG. 6 is a sectional view of an inner mold plate with a filler piece according to FIG. 5.

The inner mold plate 1 has perpendicularly extending webs 5 on its inner side 3. Consequently, grooves 6 with a groove width a extend between the webs 5. As can be seen particularly in FIG. 3, the grooves 6 have undercuts 6' with an undercut thickness b. Threaded bolts 8 are welded to the filler pieces 7 as shown in FIG. 2. The filler pieces and, thus, also the inner plate 1, are screwed by means of the threaded bolts 8 to the water box 2. Consequently, the screw connections between the inner mold plate and the water box 2 are arranged between the filler pieces 7 and the water box 2.

Figure 3:
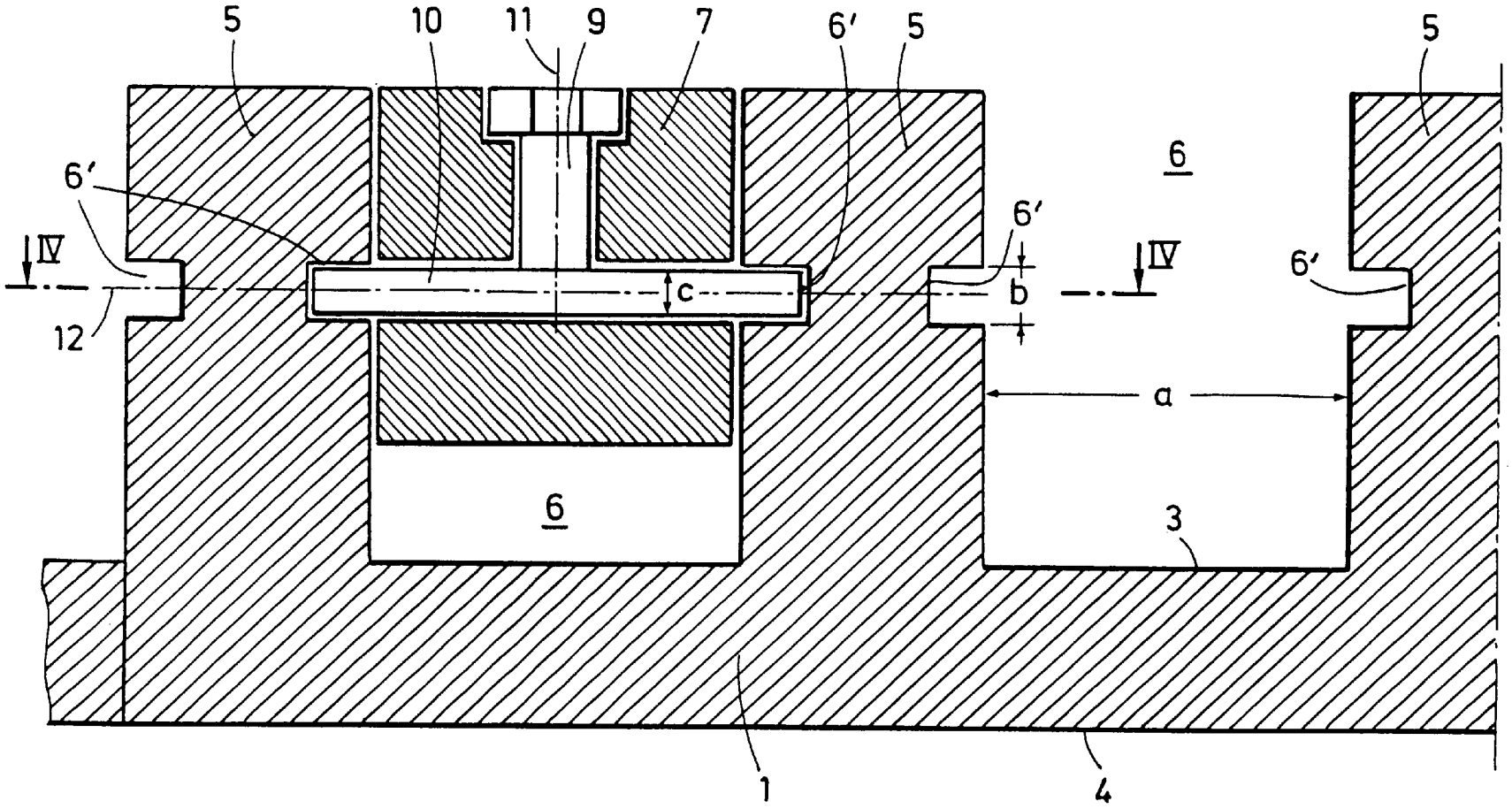
FIG. 3 is a sectional view of an inner mold plate of the mold wall.
Figure 4:
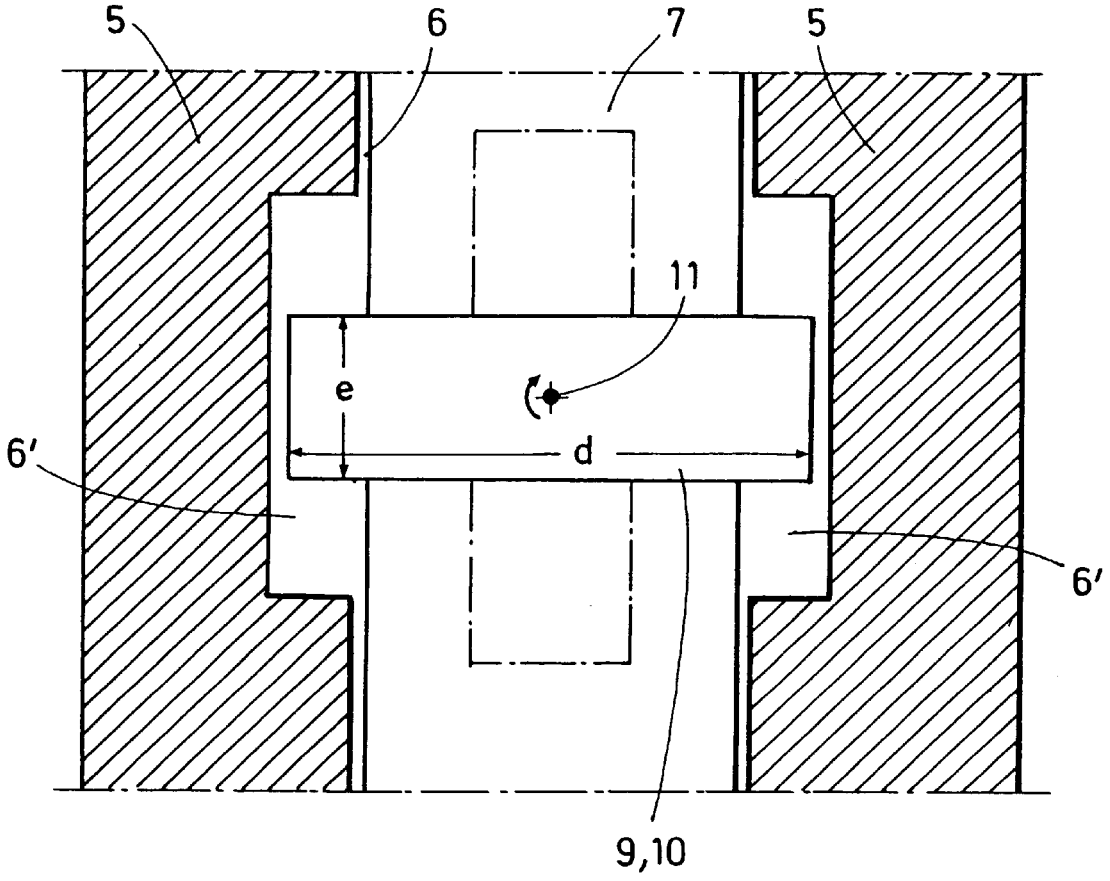
FIG. 4 is a sectional view along sectional line IV—IV of FIG. 3.

The connection between the filler pieces 7 and the inner mold plate 1 is illustrated in more detail in FIGS. 3 and 4.

As shown in FIGS. 3 and 4, the filler pieces 7 have connecting elements 9. The connecting elements 9 have a connecting element thickness c. The connecting elements 9 engage with swivel elements 10 releasably in the undercuts 6'. The swivel elements 10 are swivelable about swivel axes 11. The swivel elements 10 have a maximum length d and a maximum width e in swivel planes 12 extending perpendicularly of the swivel axes 11. The maximum length d is greater than the groove width a. In the illustrated embodiment, the maximum width e is smaller than the groove width a. However, the maximum width e could also be equal to the groove width a.

The connecting elements 9 can be moved out of the filler pieces 7 by swivelling the swivel elements 10 in their swivel plane 12. As a result, the connecting elements 9 engage releasably in the undercuts 6' and the filler pieces 7 can be connected in a positively engaging manner with the inner mold plate 1.

As illustrated in FIG. 4, the swivel elements 10 have a rectangular cross-section. However, the cross-section could also be different, for example, elliptical or oval. The connecting element thickness c is smaller than the undercut thickness b as seen in FIG. 3. As a result, the swivel elements 10 can be inserted particularly easily into the undercuts 6'. Alternatively, the connecting elements 9 and/or the undercuts 6' could also be constructed so as to be conical.

Figure 5:
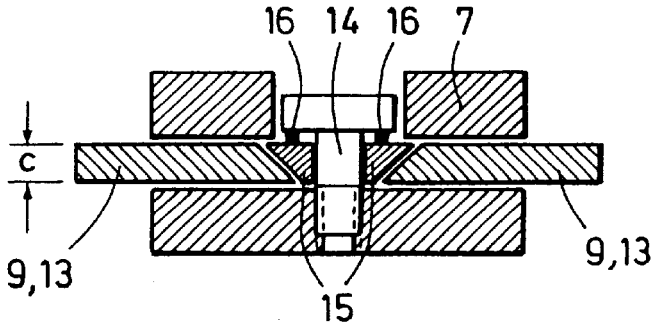
FIG. 5 is a sectional view of a filler piece.

As an alternative to the configuration of the connecting elements 9 with swivel elements 10, the connecting elements 9 may also have conically tapering expanding plates 13, as shown in FIG. 5. The expanding plates 13 can be expanded by means of screws 14 so as to move into the undercuts 6'. As further illustrated in FIG. 5, the expanding plates 13 can be moved out by arranging conically tapering spreading discs 15 between the screws 14. Alternatively or additionally, the screws 14 could be constructed so as to be conically tapering, at least over a portion of the screws 14.

In order to ensure that the positive engagement between the webs 5 and the filler pieces 7 is securely maintained even when the mold wall is heated, spring elements 16, shown in FIG. 5, are provided for the connecting elements 9. In the illustrated embodiment, the spring elements 16 are constructed as O-rings of a permanent elastic material which is resistant to the temperature occurring during continuous casting and has a sufficient thickness.

The mold wall according to the present invention provides a number of advantages. For example, it is not necessary to provide bores on the rear side of the inner mold plate 1. In addition, it is not necessary to place threaded inserts into the inner mold plate 1. The grooves 6 which serve as the cooling ducts may have a uniform spacing between each other. Used-up inner mold plates 1 have a higher scrap value because they are free of steel impurities. Finally, the threaded bolts 8 have no thermal influence on the inner mold plate 1 because they are not welded to the inner mold plate 1 but to the filler pieces 7.

It should additionally be mentioned that the mold wall according to the present invention does not have to have any vertical deep hole bores in the areas of the webs 5 for the threaded pieces. Also, a fitting groove in the filler pieces 7 and the inner mold plate 1 is not required.

While specific embodiments of the invention have been described in detail to illustrate the inventive principles, it will be understood that the invention may be embodied otherwise without departing from such principles.

I claim:

1. A mold wall of a continuous casting mold comprising an inner mold plate and a water box connected to the inner mold plate through screw connections, wherein a side of the inner mold plate facing the water box has webs defining grooves therebetween, and filler pieces arranged in the grooves, wherein the grooves have undercuts, wherein the filler pieces have connecting elements mounted so as to be releasably engaged in the undercuts, and wherein the screw connections are arranged between the filler pieces and the water box.

2. The mold wall according to claim 1, wherein the connecting elements have a connecting element thickness and the undercuts have an undercut thickness, and wherein the connecting element thickness is smaller than the undercut thickness.

3. The mold wall according to claim 1, wherein at least one of the connecting elements and the undercuts are shaped conically.

4. The mold wall according to claim 1, wherein the connecting elements are configured to be moveable out of the filler pieces.

5. The mold wall according to claim 4, wherein the connecting elements comprise swivel elements mounted so as to be swivelable about swivelling axes, wherein the swivel elements have a maximum length and a maximum width in swivel planes extending perpendicularly from the swivel axes, wherein the grooves have a groove width, wherein the maximum length is greater than the groove width, and wherein the maximum width is at most equal to the groove width.

6. The mold wall according to claim 5, wherein the swivel elements have in the swivel planes have one of a rectangular, elliptical and oval cross-section.

7. The mold wall according to claim 4, wherein the connecting elements comprise expanding plates and screws configured to move the expanding plates into the undercuts.

8. The mold wall according to claim 7, further comprising conically tapering spreading discs mounted between the screws and the expanding plates.

9. The mold wall according to claim 7, wherein the screws each have a conically tapered portion.

10. The mold wall according to claim 7, further comprising spring elements at the connecting elements for maintaining a positive engagement of the connecting elements when the mold wall is heated.

* * * * *